US006525599B2

(12) United States Patent
Nguyen et al.

(10) Patent No.: US 6,525,599 B2
(45) Date of Patent: Feb. 25, 2003

(54) CHANGEABLE VOLTAGE REGULATOR FOR A COMPUTER PROCESSOR

(75) Inventors: Don Nguyen, Portland, OR (US); John Deignan, Tigard, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/893,476

(22) Filed: Jun. 29, 2001

(65) Prior Publication Data

US 2003/0001664 A1 Jan. 2, 2003

(51) Int. Cl.[7] ..... G05F 1/10
(52) U.S. Cl. ..... 327/544
(58) Field of Search ..... 327/407, 512, 327/513, 530, 534, 535, 544, 545

(56) References Cited

U.S. PATENT DOCUMENTS 5,861,861 A * 1/1999 Nolan et al. ..... 345/205
6,094,367 A * 7/2000 Hsu et al. ..... 327/538
6,185,139 B1 * 2/2001 Pantelakis et al. ..... 365/201
6,316,988 B1 * 11/2001 Forehand et al. ..... 323/283

* cited by examiner

*Primary Examiner*—Jeffrey Zweizig
(74) *Attorney, Agent, or Firm*—Antonelli, Terry, Stout & Kraus, LLP

(57) ABSTRACT

A voltage regulator for a computer processor having different voltage levels. When a processor starts up from a temperature which is colder than its operating temperature, it requires a higher voltage than normal. A multiplexer selects either the normal voltage or the higher voltage depending on whether the device has been running or just turned on. The selected signal controls the voltage regulator to produce the desired voltage for the processor. Selections may also be made based on other circumstances such as the end of a sleep state or a different mode of operation.

25 Claims, 1 Drawing Sheet

CHANGEABLE VOLTAGE REGULATOR FOR A COMPUTER PROCESSOR

FIELD

The present invention is related to a voltage regulator for a computer processor having different voltage settings. More particularly, the present invention is related to a voltage regulator for a computer processor where the voltage setting may be changed if the processor is at a cold temperature.

BACKGROUND

In processor chips for computers and other electronic equipment, the amount of power used is an important factor which needs to be controlled. In some environments, power is provided by a battery or other limited power source so that the use of small amounts of power is desirable. For many types of devices, the amount of power determines the amount of heat generated, which must be dissipated in order for the device to work properly. For these and a number of other reasons, it is important that the amount of power utilized be kept small. It is also important to keep the variation in the power dissipation as small as possible, so that the power supplied is somewhat constant.

The power utilized for a switching element can be divided into a leakage part and a dynamic part. The leakage part exists even if the component stops executing any new instruction or if the processor is doing nothing. The dynamic part is the part which is actually utilized when the processor and element are active. The active portion is often about 60–70% of the total amount of power utilized . This active portion is proportional to the square of the voltage, based on the basic formula of power equals the square of the voltage divided by the resistance. However, because this power is used only when the switching is active, the power is also proportional to the frequency of switching. This relates to the amount of time that the switching element is active. Since the power is proportional to the square of the voltage, it is important that the supply voltage be kept as constant as possible. Any changes in the supply voltage will produce even larger changes in the power function.

Unfortunately, many electronic elements and especially switching devices such as CMOS devices have a temperature dependency. For a given temperature range, the switching frequency capability of the device depends on the supply voltage. Likewise, the ability to turn on and off the device depends on the supply voltage. Similarly, for a given supply voltage the switching frequency capability of the device depends on the temperature. It should especially be noted that if the device is cold it may not work at all, especially if the applied voltage is low. Other variables such as interconnecting power delivery issues may also depend on the temperature.

Thus, it is important that the supply voltage for a processor having CMOS devices remain within appropriate limits for the temperature range it was designed. One example is that a processor, such as the LV-Pentium-III™, running at 300 MHz has a desirable supply voltage of 0.975V±25 mV at a temperature of 15° C.

However, if the device is colder than this it is necessary to increase the supply voltage in order to keep the device running at 300 MHz. This compensation is on the order of 1 mV/° C. For example, if the supply voltage is nominally 0.975V at 15° C., and the processor is actually at 0° C., the supply voltage must be raised to 0.990V. Thus, a 15 mV adjustment is added due to the temperature variation. This increase of 15 mV will increase the processor core power dissipation by about 3%. If the supply voltage is not increased, many of the processors will not operate properly and accordingly will not pass the required standard tests. However, if the supply voltage is adjusted to be higher when the temperature is cold, many more of the processors will pass the test and be usable. Thus, it is desirable to have a supply voltage which changes depending on the temperature of the processor so that the percentage of manufactured processors which pass the tests is as high as possible.

BRIEF DESCRIPTION OF THE DRAWINGS

The foregoing and a better understanding of the present invention will become apparent from the following detailed description of example embodiments and the claims when read in connection with the accompanying drawings, all forming a part of the disclosure of this invention. While the foregoing and following written and illustrated disclosure focuses on disclosing example embodiments of the invention, it should be clearly understood that the same is by way of illustration and example only and that the invention is not limited thereto. The spirit and scope of the present invention are limited only by the terms of the appended claims.

The following represents brief descriptions of the drawings, wherein.

DETAILED DESCRIPTION

Figure 1:
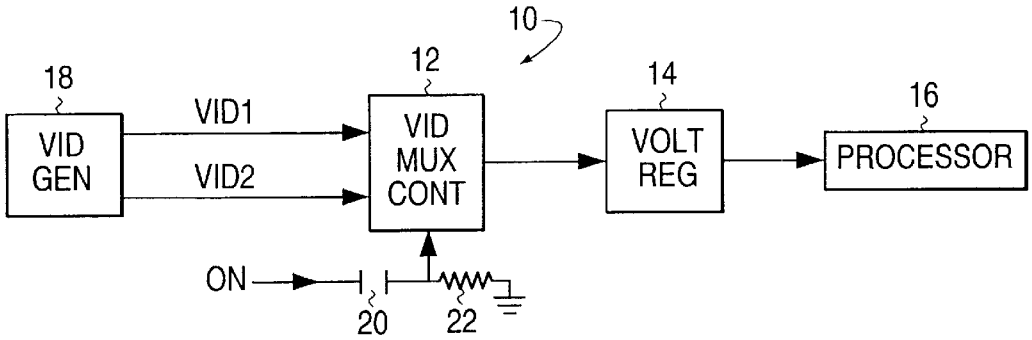
FIG. 1 is an example advantageous embodiment of the present invention.

Before beginning a detailed description of the subject invention, mention of the following is in order. When appropriate, like reference numerals and characters may be used to designate identical, corresponding or similar components in differing figure drawings. Further, in the detailed description to follow, example sizes/models/values/ranges may be given, although the present invention is not limited to the same. With regard to description of any timing signals, the terms assertion and negation may be used in an intended generic sense. More particularly, such terms are used to avoid confusion when working with a mixture of "active-low" and "active-high" signals, and to represent the fact that the invention is not limited to the illustrated/described signals, but could be implemented with a total/partial reversal of any of the "active-low" and "active-high" signals by a simple change in logic. As a final note, well known power/ground connections to ICs and other components may not be shown within the FIGS. for simplicity of illustration and discussion, and so as not to obscure the invention. Further, arrangements may be shown in block diagram form in order to avoid obscuring the invention, and also in view of the fact that specifics with respect to implementation of such block diagram arrangements are highly dependent upon the platform within which the present invention is to be implemented, i.e., such specifics should be well within purview of one skilled in the art. Where specific details (e.g., circuits, flowcharts) are set forth in order to describe example embodiments of the invention, it should be apparent to one skilled in the art that the invention can be practiced without, or with variation of, these specific details. Finally, it should be apparent that differing combinations of hard-wired circuitry and software instructions can be used to implement embodiments of the present invention, i.e., the present invention is not limited to any specific combination of hardware and software.

A processor system 10 is shown in FIG. 1 as including a processor 16 which could be any processor, for example, an LV-Pentium-III™ processor operating at 300 MHz and designed for a voltage of 0.975V. The processor is connected to a voltage supply such as a voltage regulator 14. This arrangement of voltage regulator and processor have been used in previous devices such as discussed above.

The voltage regulator has an output voltage which may be determined by a digital input signal. This digital input signal is converted to an analog signal within the voltage regulator and is used as the reference to control the output voltage which is applied to the processor.

However, prior art devices do not recognize the problem that the voltage needs to be increased when the device is cold. The present invention compensates for the coldness of the device by temporarily applying a higher voltage signal to the voltage regulator, thus causing the applied voltage to the processor to be increased on a temporary basis. The arrangement for doing this includes a voltage identification (VID) multiplexer 12 and a voltage identification generator 18. The VID generator 18 generates two different digital signals which correspond to the two different temperature levels such as 0.975 and 0.99V which are used for warm or cold operation, respectively. The VID multiplexer 12 receives these two possible signals and transmits only one of them to the voltage regulator. The one which is selected is determined by the control input applied to the bottom of the multiplexer. This control input will switch between the two possible VID signals depending on whether the control input is at the high or low logic level. When the control input is logically high, the VID2 signal is passed to the voltage regulator. When the control signal is logically low, the VID1 signal is passed to the voltage regulator.

The control input of the multiplexer 12 is connected to a circuit at a point between resistor 22 and capacitor 20. The other side of the resistor is connected to ground. The other side of the capacitor is connected to a logic signal, ON. This logic signal is high when the device is turned on and low when it is off. When the device is off, the voltage at the control input is low due to the pull down effect of the resistor connected to ground. Capacitor 20 is also fully discharged. However, when the device is turned ON, the on signal goes from low to high with a very fast edge so that the capacitor AC couples the transition which pulls the control input to a high level. However, the capacitor and resistor determine a RC time constant through which the high voltage will discharge to ground and leave the control input at a low level.

Thus, when a device is first turned on the control input immediately goes high causing the multiplexer to pass the VID2 signal to the voltage regulator causing the higher voltage to be applied to the processor. After a relatively short time determined by the RC time constant, the control signal returns to a low level so that the multiplexer then passes the VID1 signal to the voltage regulator and the lower voltage level is applied to the processor. The RC time constant can be adjusted by changing the values of the resistor and capacitor. The time constant should be made to equal the amount of time necessary for the processor to warm up so that its internally generated heat will continue to keep it at a warmer temperature.

The above description assumes that the device will always be cold enough to need the higher voltage level to get started. It is also possible that the ambient conditions will keep the device at a high enough temperature that this procedure is not necessary. Accordingly, it is possible to include an internal temperature sensor such as a thermal diode which can be read by a thermal sensor chip. This temperature measurement can then be used to control the VID generator to generate the VID2 signal for the initial turn on period or, if the device is not cold, this signal will not be generated and instead the VID1 signal could be generated instead.

It would also be possible to have the series of different signal stored in the VID generator for different starting temperatures. Thus, the highest voltage signal would only be generated by the VID generator when the temperature is the coldest. Other intermediate voltage signals to be generated for various intermediate temperatures and the VID1 signal could be generated if the device is already warm. Thus, the signal which is generated and controls the voltage regulator during the start-up period could vary depending on the start-up temperature.

Figure 2:
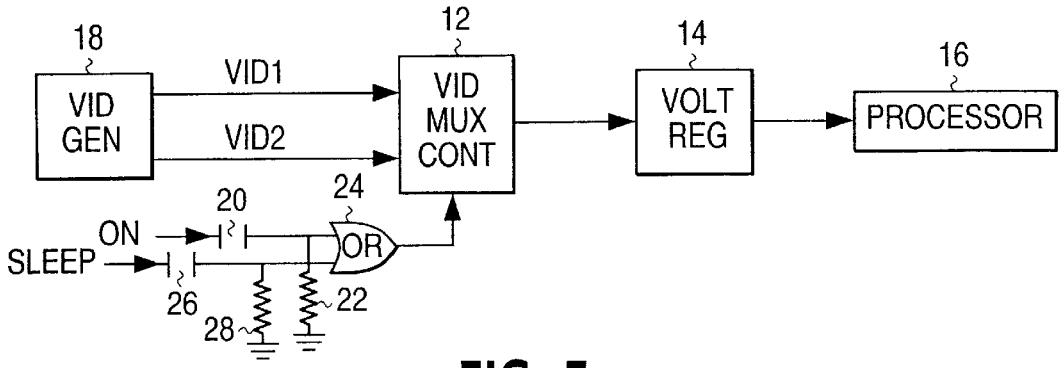
FIG. 2 is a second example advantageous embodiment of the present invention.

While the above embodiment describes the controlling of the voltage to overcome a cold start, there are other conditions that might warrant an increase in the voltage. FIG. 2 shows a second embodiment including a similar arrangement of processor, voltage regulator, multiplexer and VID generator. These devices operate in the same manner as described above in regard to FIG. 1. However, the control input to the multiplexer operates in an entirely different fashion. Two different possible signals may cause the control to go to a high level and the two signal inputs are OR connected through OR gate 24 so that either input can cause the control input to rise. One input to the OR gate is the ON signal with capacitor 20 and resistor 22 which operate in the same fashion as described in FIG. 1. This signal causes the VID 2 signal to be applied to the voltage regulator when the device is first turned on. However an additional circuit including capacitor 26 and resistor 28 is connected in a similar fashion to ground and operates with an RC constant in the same manner. However, the input signal SLEEP relates to the use of a Deep-Sleep-State which is available in some processors. This state is an extremely low power state where the processor and voltage regulator are actually on but the power dissipation is very low. It is possible that during such a Deep-Sleep-State that the amount of power consumed is not enough to keep the processor warm so that it may actually drop below the normal 15° C. operating temperature. During the Deep-Sleep-State no instructions are being processed so that it is not necessary to keep the device warm while it is sleeping. However, when the SLEEP signal goes to a high condition meaning that the processor should exit the sleep state and become active, the input operates in the same fashion as the ON signal discussed above. That is, for an initial time when the SLEEP signal is received, the voltage applied will be larger with a time being determined by the RC constant. Thus, the second embodiment will work in a fashion similar to the embodiment of FIG. 1 except that the initial time period during which a larger voltage is applied can be caused by either the turn-on signal or the end of sleep signal.

Figure 3:
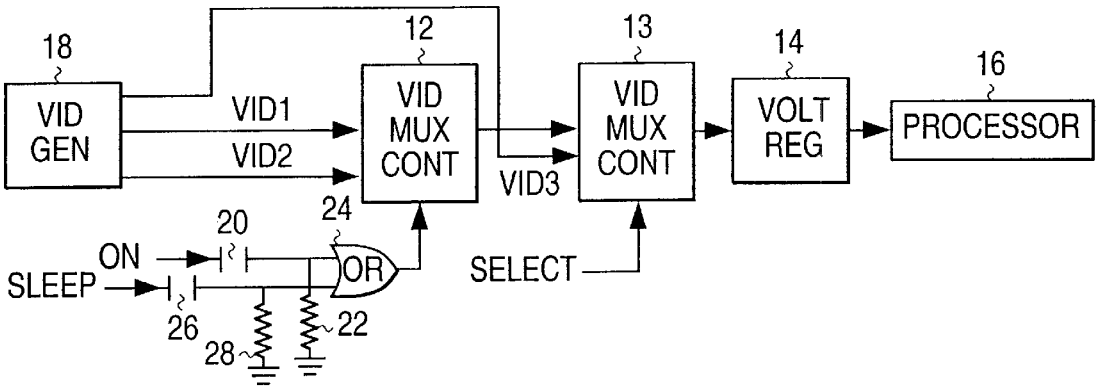
FIG. 3 is a third example advantageous embodiment of the present invention.

FIG. 3 shows a third embodiment where an additional condition is added which can change the voltage applied to the processor. In this figure processor 16 and voltage regulator 14 operate in the same fashion as described above. Also, VID generator 18 and multiplexer 12 operate in the same fashion as the second embodiment with the control input being controlled by two signals ON and SLEEP, as discussed in regard to FIG. 2. However, this embodiment includes an additional multiplexer 13, an additional input VID3 and an additional control input.

Generator 18 and multiplexer 12 operate to determine the voltage signal normally applied to the voltage regulator in the same fashion as described above.

However, the output of the multiplexer is then sent to an additional multiplexer 13 so that the system can choose between this input and an input VID3 which corresponds to a higher voltage level such as 1.1 volts. Multiplexer 13 chooses between the normal signals described above and this new high voltage level. The multiplexer is controlled by an input signal SELECT which goes high when the higher voltage level is desired so that multiplexer 13 selects VID3 when the SELECT signal is high and merely passes the signal from multiplexer 12 when the SELECT signal is low. Thus, unless the SELECT signal indicates that this higher voltage is desired, the device of FIG. 3 operates in the same fashion as the device of FIG. 2. This type of system is designed for use when there are more than one mode of operation in a processor. For example, if the device can operate in two modes such as a battery optimized mode and a performance optimized mode, which require different voltage levels, the SELECT signal determines which mode is desirable. However, this system would be useable anytime when there is a difference in voltage levels which is desired. The SELECT signal may be manually input or may be automatically input from other parts of the system when it is determined that the higher voltage level is necessary for that mode of operation.

VID3 may be generated through the VID generator 18 based on a stored signal. Alternatively, it may be generated elsewhere in the system if desired.

Figure 4:
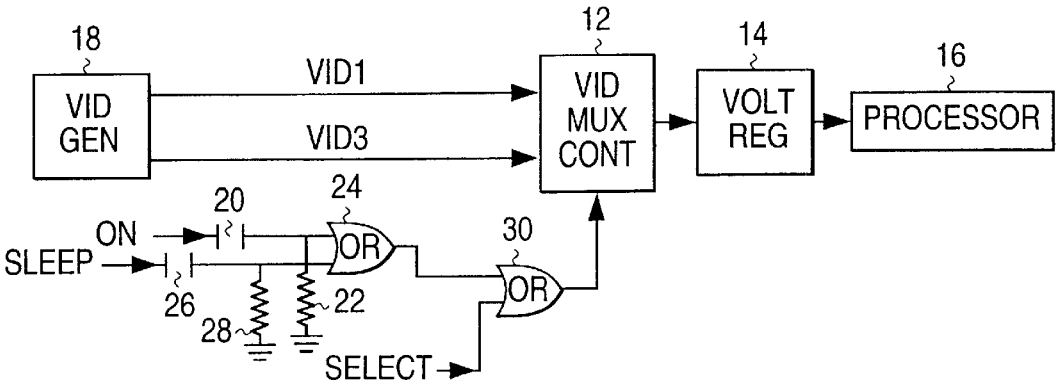
FIG. 4 is a fourth example advantageous embodiment of the present invention.

FIG. 4 shows a simplified version of the embodiment of FIG. 3. In this system, a single multiplexer 12 is used rather than the pair of multiplexers shown in FIG. 3. However, the operation of the generator 18, voltage regulator 14 and processor 16 is exactly the same. Multiplexer 12 also operates in the same fashion However, the inputs differ from those of the other embodiments. The first input to the multiplexer is VID1 and relates to the normal operating voltage such as 0.975 volts. VID3, as indicated in the embodiment of FIG. 3, relates to a high voltage such as 1.1 volts which may be used during certain modes of operation. Multiplexer 12 is controlled to select one of these two signals. Thus, the VID2 signal is eliminated by using the VID3 signal for the warm-up voltage as well. Since this voltage typically is larger than VID2, the time constants may need to be adjusted to a shorter time so that power is not wasted.

The control input to the multiplexer is controlled by three input signals. The first two signals are the ON and SLEEP signals connected through an RC time circuit and joined through OR gate 24 in the same fashion shown in FIGS. 2 and 3. The output of OR gate 24 is then applied as one input to OR gate 30, with the other input being the SELECT signal. This SELECT signal operates in the manner described in FIG. 3 but is combined with the output of OR gate 24 to form a single control input to multiplexer 12.

Thus, multiplexer 12 operates in the following fashion. If the device is turned on or if it emerges from a Deep Sleep, a high level signal is generated for a certain time period and is applied to the control input through OR gate 24 and OR gate 30. During the time that this input is high, the higher voltage level VID3 is applied to the voltage regulator and processor in order to warm the processor during this initial time period. Once the initial time period is passed, the RC constants of the circuits cause the inputs to OR gate 24 to go to a lower level so that the control input is low and multiplexer 12 passes the VID1 signal to the voltage regulator causing the processor to have the normal 0.975 volts applied thereto. During certain modes of operation, the SELECT signal will go high causing this high signal to be applied to the control input by way of OR gate 30. During this mode of operation the VID3 signal is applied to the voltage regulator so that the higher voltage such as 1.1 volt is applied to the processor. Thus, this arrangement simplifies the embodiment of FIG. 3 by eliminating one multiplexer and the VID2 signal. However, the operation is otherwise the same.

In the embodiment of FIG. 1, the possibility of a temperature sensor was described along with the possibility of other intermediate VID signals which depend on temperature. This arrangement could also be applied to the other embodiments where the temperature sensor is used to control the voltage identification signal generated by the VID generator 18.

In concluding, reference in the specification to "one embodiment", "an embodiment", "example embodiment", etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. Furthermore, for ease of understanding, certain method procedures may have been delineated as separate procedures; however, these separately delineated procedures should not be construed as necessarily order dependent in their performance, i.e., some procedures may be able to be performed in an alternative ordering, simultaneously, etc.

This concludes the description of the example embodiments. Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

What is claimed is:

1. An apparatus for generating a plurality of voltages comprising:

a generator to generate a plurality of voltage identifiers;

a multiplexer to select one of the voltage identifiers;

a voltage regulator to receive the selected voltage identifier and produce a voltage output corresponding thereto for application to a predetermined circuit; and a control circuit to apply a control signal to the multiplexer to control the selection of the voltage identifier, the control signal being related to a thermal state of the predetermined circuit.

2. The apparatus according to claim 1, wherein the control circuit includes a resistor connected at one end to a capacitor and at another end to ground, the capacitor connected at another end to an input signal so that a control signal is generated when an input signal is received for a period determined by the RC constant of the circuit.

3. The apparatus according to claim 2, wherein the input signal indicates a turn on of the predetermined circuit.

4. The apparatus according to claim 2, wherein the input signal indicates that a sleep mode of the predetermined circuit has ended.

5. The apparatus according to claim 1, comprising a temperature measuring device to provide a temperature measurement, wherein the selected voltage identifier is selected based on the temperature measurement.

6. The apparatus according to claim 1, comprising a second multiplexer to select one of an additional voltage identifier and the selected voltage identifier based on a select signal and to apply the selected signal to the voltage regulator.

7. The apparatus according to claim 1, wherein one of the voltage identifiers corresponds to a voltage of a first mode of operation and a second voltage identifier corresponds to a second mode of operation, and wherein the second voltage identifier is selected in accordance with a select signal for the corresponding mode of operation or in accordance with the signal indicating that a processor is turned on or exiting from sleep.

8. An apparatus according to claim 1, wherein the control circuit applies a first control signal for a first predetermined period of time, and applies a second control signal after the first predetermined period of time.

9. An apparatus according to claim 8, wherein the first control signal relates to a warm-up state of the predetermined circuit, and the second control signal relates to a warmed-up state of the predetermined circuit.

10. An apparatus according to claim 8, wherein the predetermined circuit is a processor circuit.

11. A method of controlling a voltage regulator comprising:

generating a plurality of voltage identifiers; and selecting one of the voltage identifiers based on a state of an input signal and applying the selected voltage identifier to a voltage regulator for generating a voltage output corresponding to the voltage identifier for application to a predetermined circuit, the selecting being related to a thermal state of the predetermined circuit.

12. A method according to claim 11, wherein the selecting of at least one of the voltage identifiers is determined according to a temperature measurement.

13. A method according to claim 11, wherein the input signal indicates an on state and causes a selection of a first voltage identifier for a set time period.

14. A method according to claim 11, wherein the input signal indicates an exit from sleep state and causes a selection of a first voltage identifier for a set time period.

15. A method according to claim 11, wherein the selecting is from three voltage identifiers where one is determined by a selected mode of operation, one is determined during a normal mode of operation and a third is determined only for a temporary time duration upon receipt of a turn on signal or an end of sleep signal.

16. A method according to claim 11, wherein the selecting comprises applying a first control signal for a first predetermined period of time, and applying a second control signal after the first predetermined period of time.

17. A method according to claim 16, wherein the first control signal relates to a warm-up state of the predetermined circuit, and the second control signal relates to a warmed-up state of the predetermined circuit.

18. A method according to claim 11, wherein the predetermined circuit is a processor circuit.

19. A system for controlling a voltage applied to a processor comprising:

a generator to generate a plurality of voltage identifiers;

a multiplexer to receive the plurality of voltage identifiers and select one therefrom as an output based on a control signal;

a voltage regulator to receive the selected voltage identifier from the multiplexer and produce an output voltage;

a processor to receive the output voltage from the voltage regulator; and a control circuit to generate a control signal applied to the multiplexer, the control signal being related to a thermal state of the processor.

20. The system according to claim 19, comprising a temperature measurement device to measure a temperature of at least one location of the system and controlling the generator to select a voltage identifier based on the temperature.

21. The system according to claim 19, wherein the control circuit includes an RC circuit producing the control signal upon receipt of an input signal for a predetermined time dependent on a RC constant of the circuit.

22. The system according to claim 21, wherein the input signal is an on signal for the processor.

23. The system according to claim 21, wherein the input signal is an exit from sleep signal.

24. The system according to claim 19, wherein the control circuit applies a first control signal for a first predetermined period of time, and applies a second control signal after the first predetermined period of time.

25. The system according to claim 24, wherein the first control signal relates to a warm-up state of the predetermined circuit, and the second control signal relates to a warmed-up state of the predetermined circuit.

* * * * *